US009091484B2

(12) United States Patent
Hegenberg et al.

(10) Patent No.: US 9,091,484 B2
(45) Date of Patent: Jul. 28, 2015

(54) METHOD AND APPARATUS FOR HEATING METALS

(71) Applicant: AIR PRODUCTS AND CHEMICALS INC., Allentown, PA (US)

(72) Inventors: Thomas Jurgen Hegenberg, Herne (DE); Linda Kuhne, Bochum (DE); Gregor Langemeyer, Dusseldorf (DE); Siegfried Schemberg, Fahrenzhausen (DE)

(73) Assignee: AIR PRODUCTS AND CHEMICALS, INC., Allentown, PA (US)

( * ) Notice: Subject to any disclaimer, the term of this patent is extended or adjusted under 35 U.S.C. 154(b) by 109 days.

(21) Appl. No.: 13/888,719

(22) Filed: May 7, 2013

(65) Prior Publication Data

US 2013/0307202 A1 Nov. 21, 2013

(30) Foreign Application Priority Data

May 18, 2012 (EP) ..... 12003932

(51) Int. Cl.
*F27D 99/00* (2010.01)
*F27B 3/28* (2006.01)
(Continued)

(52) U.S. Cl.
CPC ..... *F27D 99/0001* (2013.01); *C22B 9/00* (2013.01); *F27B 3/28* (2013.01); *F27B 7/10* (2013.01); *F27B 7/42* (2013.01); *F27D 19/00* (2013.01); *F27D 21/0014* (2013.01); *F27D 21/02* (2013.01); *F27D 99/0033* (2013.01); *F27D 2019/0006* (2013.01); *F27D 2019/0034* (2013.01)

(58) Field of Classification Search
CPC . C22B 21/02; C22B 21/0084; F27D 99/0001; F27D 19/00; F27D 21/00
USPC ..... 266/44, 213, 78, 80, 81
See application file for complete search history.

(56) References Cited

U.S. PATENT DOCUMENTS 6,245,122 B1 6/2001 Meyers
6,247,416 B1 6/2001 Beaudoin et al.
(Continued)

FOREIGN PATENT DOCUMENTS

DE 103 25 556 A1 12/2004
EP 0 475 128 A1 3/1992
(Continued)

OTHER PUBLICATIONS

Nyssen, P., et al. "Innovative visualisation technique at the electric arc furnace", La Revue de Metallurgie-CIT, Sep. 2006, pp. 369-373.

*Primary Examiner* — Scott Kastler
(74) *Attorney, Agent, or Firm* — Larry S. Zelson

(57) ABSTRACT

A method of heating a non-ferrous and/or ferrous metal-containing stock in a furnace with a heating chamber, a charging door, an exhaust stream port and an exhaust stream duct, which includes: a) introducing fuel and an oxygen-containing gas into the heating chamber of the furnace through a burner so that a flame is formed, b) monitoring the signal of at least one optical sensor installed within the heating chamber and/or the exhaust stream duct, c) monitoring the change of the temperature T of the exhaust stream with time (dT/dt), and d) adjusting the fuel:oxygen ratio in step a) as a function of the signal of the flame sensor(s) and dT/dt in the exhaust stream, and, an apparatus designed for implementing said method.

16 Claims, 3 Drawing Sheets

(51) Int. Cl.

| | |
|---|---|
| ***F27B 7/10*** | (2006.01) |
| ***F27B 7/42*** | (2006.01) |
| ***F27D 19/00*** | (2006.01) |
| ***F27D 21/00*** | (2006.01) |
| ***F27D 21/02*** | (2006.01) |
| ***C22B 9/00*** | (2006.01) |

(56) References Cited

U.S. PATENT DOCUMENTS

| | | | | |
|---|---|---|---|---|
| 7,462,218 | B2 | 12/2008 | Ducrocq | |
| 7,648,558 | B2 * | 1/2010 | Allemand et al. | 75/385 |
| 7,648,588 | B2 | 1/2010 | Hammond et al. | |
| 7,655,067 | B2 | 2/2010 | Lucas et al. | |
| 2004/0012129 | A1 | 1/2004 | Summer | |
| 2006/0196400 | A1 * | 9/2006 | Martin et al. | 110/341 |
| 2013/0307202 | A1 * | 11/2013 | Hegenberg et al. | 266/44 |

FOREIGN PATENT DOCUMENTS

| | | | |
|---|---|---|---|
| EP | 0 553 632 | A2 | 8/1993 |
| EP | 0 756 014 | A1 | 1/1997 |
| EP | 0 962 540 | A1 | 12/1999 |
| EP | 1 243 663 | A2 | 9/2002 |
| EP | 2 290 310 | A1 | 2/2011 |
| GB | 2 150 269 | A | 6/1985 |
| WO | 0133200 | A1 | 5/2001 |
| WO | 2004108975 | A1 | 12/2004 |
| WO | 2006117336 | A1 | 11/2006 |
| WO | 2011131880 | A1 | 10/2011 |

* cited by examiner

METHOD AND APPARATUS FOR HEATING METALS

CROSS-REFERENCE TO RELATED APPLICATIONS

This application claims the priority of European Patent Application No. 12003932.6, filed May 18, 2012, which is incorporated by reference herein in its entirety.

BACKGROUND OF THE INVENTION

The present invention relates to a method of heating a non-ferrous and/or ferrous metal-containing stock in a furnace with a heating chamber, a charging door, an exhaust stream port and an exhaust stream duct wherein fuel and an oxygen-containing gas are introduced into the furnace so that a flame is formed, and to an apparatus for performing said method. By heating it is meant to include melting, heating, recycling, smelting and otherwise processing metals by application of heat.

Heating of non-ferrous and ferrous metal containing stocks, in particular aluminium containing stocks, in furnaces is well-known in the art. A problem which occurs in these processes is that the composition and quality of the stocks used for heating is usually varying. For example, organic components such as e.g. oils, lacquer, paper, plastics, rubber, paints, coatings etc. may be present in the material to be heated. These organic materials are pyrolized when the volatilisation temperature is attained and, when oxygen is deficient, brought out to the exhaust duct of the furnace as CO or uncombusted hydrocarbons. The gas cleaning systems usually employed are not able to completely eliminate these unwanted noxious substances from the exhaust stream which are, hence, emitted to the environment if no further measures are taken.

In the art, several attempts have been made to improve the combustion efficiency in the furnace so as to lower the emission of the noxious substances to the environment. For example, in U.S. Pat. Nos. 7,462,218, 7,648,558 and 7,655,067 processes are disclosed in which the variation of CO and/or $H_2$ concentration in the exhaust gases and the temperature thereof are measured, and the fuel flow to the furnace is adjusted accordingly.

EP 553 632 discloses a process in which continuously the temperature of the exhaust gas stream from the furnace is measured and, when the temperature exceeds a pre-determined value, the oxygen content in the furnace is increased.

In EP 1 243 663, a process is disclosed in which the $O_2$ content in the exhaust gases of the furnace is measured and this measurement is then used as a guide variable for the control unit.

WO 2004/108975 discloses a process in which the $O_2$ and CO content in the exhaust gases of the furnace are measured and the additional injection of oxygen is controlled using those measurements.

Finally, in EP 756 014, a process is disclosed in which the concentration of hydrocarbons in the exhaust gases from the furnace is measured and the volume of oxygen and/or the volume of fuel introduced into the furnace is set as a function of the measured concentration of said substances.

The disclosure of the previously identified patents and patent applications is hereby incorporated by reference.

In spite of these prior art processes there is still the need for an improved control of heating processes, in particular of the combustion taking place in a heating furnace, in order to minimize the emission of noxious substances, such as CO and hydrocarbons, to the environment, and to increase the overall efficiency of the furnace.

It is therefore the object of the present invention to provide such an improved process, in particular for heating of heavy organic contaminated stocks.

BRIEF SUMMARY OF THE INVENTION

The present invention is based on the finding that an improved control of the heating process can be achieved by a simultaneous monitoring of the combustion intensity in the exhaust and the temperature change dT/dt in the exhaust stream from the furnace, and adjusting the fuel:oxygen ratio introduced into the furnace as a function of the signal of the combustion intensity and dT/dt of the exhaust stream. By combustion intensity it is meant to refer to the intensity of the radiation emitted from combustion processes as typically measured using a ultra-violet or infrared sensor or flame monitoring device.

In one aspect of the invention, the combustion intensity is monitored by using an optical detection system. An example of a suitable optical detection system comprises a flame sensor.

The present invention therefore provides a method of heating a non-ferrous and/or ferrous metal-containing stock in a furnace with a heating chamber, a charging door, an exhaust stream port and an exhaust stream duct, which comprises a) introducing fuel and an oxygen-containing gas into the heating chamber of the furnace through a burner so that a flame is formed,
b) monitoring the signal of at least one optical sensor installed within the heating chamber and/or exhaust stream,
c) monitoring the change of the temperature T of the exhaust stream with time (dT/dt), and
d) adjusting the fuel: oxygen ratio in step a) as a function of the signal of the optical sensor(s) and dT/dt in the exhaust stream.

The exhaust stream port means the exit location from the furnace where the furnace gases are designed to exit the furnace. The exhaust port is either directly connected to a closed exhaust stream duct, or associated with an open exhaust stream duct (e.g., an open exhaust stream duct permits entrainment of ambient air). The exhaust stream duct means the duct work associated with conveying the exhaust stream from an open or closed exhaust stream duct.

In one aspect of the invention, monitoring the signal of at least one optical sensor comprises a flame sensor installed within at least one of the heating chamber and the exhaust stream duct.

The method according to the invention allows for an improved control of the heating process, especially for heating of heavily organically contaminated stocks. In particular, the method allows for a quick and precise adjustment of the fuel: oxygen ratio introduced into the furnace in response to the monitored parameters. The "fuel:oxygen ratio" is defined herein as the molar ratio between fuel and oxygen.

Thus, the heating process can be controlled so that, as far as possible, the combustion of all combustible materials available in the furnace is completed inside the furnace. This leads to a reduction of the emissions of noxious substances, such as CO and hydrocarbons, and an increase in the furnace efficiency by keeping the heat of combustion of organic compounds inside the furnace. In addition, a significantly lower exhaust gas temperature in the ducts is achieved which prevents damages of exhaust gas ducts due to overheating. Furthermore, by lowering the exhaust gas temperature, dust particles carried with the exhaust gas flow into the filter systems are not sintered into the piping system, which would require additional cleaning and maintenance efforts.

Still further, due to the higher furnace efficiency a lower fuel consumption is achieved by using the calorific heat of the combustible contaminants contained in the charging stock. Finally, the system can be fully automated so that the furnace operation is made easier and operating errors are prevented.

The optical sensor(s) or flame sensor(s) are preferably arranged for delivering a gradually, or even more preferably a continuously, varying signal depending on a combustion intensity, and most preferably are arranged for delivering a signal which is directly proportional to a combustion intensity. This may be achieved by using only one optical sensor, e.g. an IR sensor, or by using a multitude of sensors, e.g. UV sensors.

In one aspect of the invention, monitoring combustion intensity comprises monitoring a flameless combustion or combustion wherein no flame is visible.

In a preferred embodiment, the furnace in the method according to the invention is a rotating cylindrical furnace, a so-called rotary drum furnace.

Rotary drum furnaces are advantageously used in particular for heating of highly contaminated stocks. The rotary movement of the furnace may be adapted to the nature and composition of the stock introduced into the furnace for heating.

The method of the invention is especially well suited for the heating of aluminum-containing stocks and, therefore, in the method the non-ferrous and/or ferrous metal preferably is aluminum.

The fuel:oxygen ratio in the method of the invention is preferably adjusted by varying the amount of oxygen introduced into the furnace and/or varying the amount of fuel introduced into the furnace.

In particular, when an (heavily) organic contaminated stock is charged into a heating furnace, the degree of combustion of the total combustibles present in the furnace varies with the amount and nature of the contaminants. Furthermore, especially in rotary drum furnaces, repeatedly new surfaces of the charged material are uncovered so that the amount of combustible contaminants liberated into the gas phase varies with time.

Thus, adjusting of the fuel:oxygen ratio is to be effected in a way so that the as far as possible all combustibles in the furnace are fully combusted therein, i.e. that the combustion is held within the furnace. Depending on the values of the signal of the optical sensor(s) and the temperature change dT/dt of the exhaust stream the amount of oxygen introduced into the furnace is increased or decreased, and/or the amount of fuel introduced into the furnace is increased or decreased.

For example, when the amount of organic contaminants liberated in the furnace increases, typically the temperature of the exhaust stream increases because the combustion in the furnace is not completed. In this case, e.g. additional oxygen is introduced into the furnace and/or fuel decreased to the burner to hold the combustion within the furnace, i.e. to complete the combustion within the furnace.

In one embodiment of the present invention where natural gas is used as the fuel, the fuel:oxygen ratio may preferably be adjusted within the range of from about 1:2, which is essentially the stoichiometric ratio for the combustion of natural gas, to about 1:6, about 1:16 or even about 1:20. For embodiments where different fuels are used the fuel: oxygen ratio may preferably be adjusted within corresponding ranges, i.e. from the stoichiometric ratio to ratios which are 3, 8 or even 10 times smaller than the stoichiometric ratio.

In a preferred embodiment, the fuel flow in the burner is controlled by compressed air activated or slam shut valves. Such valves allow for a very quick adjustment of the fuel flow.

In one embodiment of the invention where a rotary drum furnace is used, also the rotating movement of the furnace may be adjusted in accordance with the detected values for the temperature change dT/dt of the exhaust stream and the signal of the optical sensor(s).

Preferably, in the method of the invention the at least one optical sensor is installed within the exhaust stream duct of the furnace.

Further preferred, the at least one optical sensor is positioned close to the exhaust stream port of the furnace, so that especially the combustion intensity near the furnace exit is determined.

Monitoring the signal of the optical sensor(s) in step b) and monitoring the temperature change dT/dt of the exhaust stream of the furnace in step c) are preferably done at two separate locations.

Preferably, the temperature change dT/dt of the exhaust stream of the furnace is recorded downstream of the location of the optical sensor(s).

Monitoring of the temperature change of the exhaust stream (dT/dt) in addition to monitoring the signal from an optical sensor gives an improved indication of the contamination of the stock to be heated and hence improves the reliability of the heating process control. In particular, false positives in the optical sensor signal due to the volatilization of salts and other components may be identified.

The temperature change dT/dt of the exhaust stream is preferably measured within the exhaust stream duct of the furnace.

The optical sensor(s) in step b) is/are preferably and advantageously IR flame scanner(s).

The properties of IR flame scanners allow for the use of only one of them in the method of the invention.

Usually, in IR flame scanners use is made of the flickering of flames to distinguish the IR signal from a flame from the IR signal of a non-flame source, such as a hot wall.

The preferred IR flame scanners accordingly create a signal as a function of changes of the IR radiation.

The radiation detector in IR flame scanners usually is an infrared-sensitive photo resistor which is sensitive for radiation with a wavelength in the range of 1 to 3 μm (e.g., the IR flame scanners detect variation in radiation). The filtering is narrowband so that the flame-specific radiation with a constantly changing frequency and rate of change, can be nearly fully utilized. That is, the IR flame scanners detect radiation generated by the flame which in turn is an indirect measurement of combustion intensity.

The analogue output signal of the detector which may, for example, be between 0 and +5 V, is a measurement for the intensity of the combustion.

The temperature change dT/dt of the exhaust stream with time is preferably measured with one or more thermocouple (s). The thermocouple(s) determine the temperature of the exhaust stream and then dT/dt is calculated.

The thermocouple(s) may be located in multiple locations in the exhaust stream and/or in the duct, but is/are, preferably, located close to the optical sensor(s).

Preferably, adjusting the fuel:oxygen ratio in step d) as a function of the signal of the optical sensor(s) and dT/dt in the exhaust stream comprises the following procedure:

i) decrease the normal fuel flow, preferably to the reliable minimum fuel flow, ii) increase the amount of the oxygen introduced to the furnace in accordance with the level of the signal of the flame sensor, iii) ramp down the amount of oxygen with a predetermined rate during a predetermined time to the normal level, iv) return the fuel flow to normal when step iii) is finished.

To avoid unwanted activation of the procedure, preferably starting conditions are set. Thus, to initiate the above procedure i) to iv) the starting conditions are preferably such that the signal from the optical sensor must be higher than a predetermined level, and, at the same time, the temperature change in the exhaust stream must be higher than a predetermined value.

In a preferred embodiment of the method of the invention, the charging door and the exhaust stream port are located at opposite sides of the heating chamber of the furnace.

It is furthermore preferred that the burner through which fuel and the oxygen-containing gas are introduced into the furnace is located at the same side where the exhaust stream port is located.

Thus, the directions of flow of the fuel/oxygen-containing gas introduced into the heating chamber of the furnace and the waste gases are in opposite directions.

Preferably, in the heating chamber of the furnace only one burner, through which fuel and oxygen-containing gas are introduced into the furnace, is present.

Still further, preferably the charging door and the location from which fuel and the oxygen-containing gas are introduced into the furnace are located at opposite sides of the heating chamber of the furnace. If desired, these features can be on the same side.

This embodiment allows for a seal-closed configuration of the charging door and hence for a complete sealing off of the furnace from the infiltration of air.

A rotary drum heating furnace wherein the charging door and the exhaust stream port are located at opposite sides of the heating chamber of the furnace and wherein the fuel and the oxygen-containing gas are introduced into the furnace through a burner from the same side where the exhaust stream port is located is described in EP 756 014. The disclosure of this document is incorporated herein by reference.

Especially, all embodiments of the furnace described in EP 756 014 are incorporated herein as preferred embodiments of the furnace in the method of the invention.

In the method of the invention it is furthermore preferred that additional oxygen-containing gas (e.g., gas containing a concentration of oxygen that is greater than air), is introduced into the furnace through a lance.

This is sometimes also denoted as "staging". It serves to improve the penetration of the flame in the heating chamber of the furnace and induce mixing therein.

The lance is preferably operated as supersonic through which gas is conducted at supersonic velocity.

Preferably, the lance is positioned in the furnace so that the additional oxygen-containing gas introduced into the furnace boosts the burner flame, more preferably the lance is positioned above the burner and introduces the additional oxygen-containing gas so that the burner flame is enhanced (e.g., elongated). The additional oxygen can increase the firing rate and in turn permit increased usage of fuel It is preferred that up to 70 vol. % of the total oxygen introduced into the furnace are introduced through said lance.

This makes it possible to adjust the flame length and to create a post combustion zone in the, preferably upper part of the, heating chamber.

The oxygen-containing gas of the burner and/or the lance preferably has an oxygen content of at least 80 vol.%, more preferably of at least 95 vol.%.

In the method of the invention the charging stock is introduced into the furnace through the charging door batch wise, or in a continuous manner.

The present invention furthermore pertains to an apparatus for performing the method of the invention in any of the above described embodiments.

In particular, the invention also pertains to an apparatus which comprises a furnace with a heating chamber, a charging door, an exhaust stream port and an exhaust stream duct, and a) a burner for introducing fuel and an oxygen-containing gas into the heating chamber so that a flame is formed, b) at least one optical sensor installed within the heating chamber and/or exhaust stream duct (e.g., either a closed or an open exhaust stream duct), c) means for monitoring the change of the temperature T of the exhaust stream with time (dT/dt), and d) means for adjusting the fuel: oxygen ratio in step a) as a function of the signal of the optical sensor(s) and dT/dt in the exhaust stream.

All above-described embodiments of the method of the invention also pertain to the apparatus where applicable.

DETAILED DESCRIPTION OF THE INVENTION

The invention will now be further described in detail by way of a preferred embodiment with reference to the attached drawings.

Figure 1:
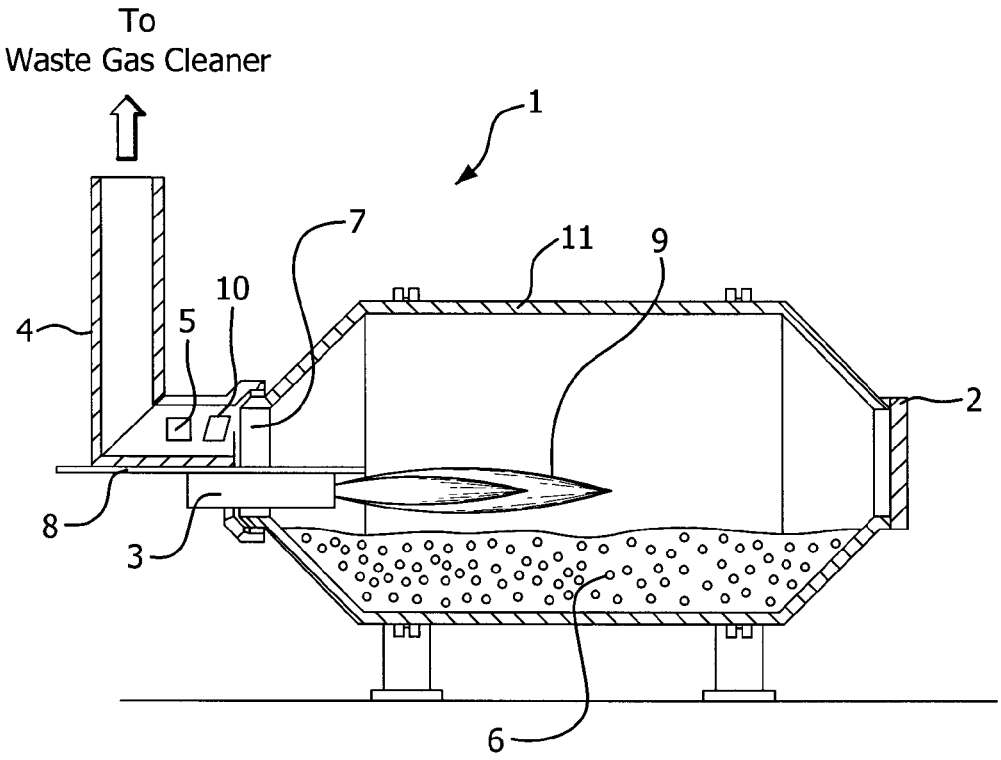
FIG. 1 shows a cross-sectional view of an embodiment of an apparatus in accordance with the invention, a rotary drum furnace, which is designed for performing the method according to the invention.

In FIG. 1, a cylindrically shaped rotary drum furnace 1 is shown. In the heating chamber 11 of the furnace 1 the charging stock 6 to be smelted is deposited. The two ends of the heating chamber 11 of furnace 1 are tapered. At one end a charging door 2 is provided, through which the charging stock 6 is introduced into or brought out of the furnace. At the end of the charging event the charging door 2 may be connected to the heating chamber 11 seal-closed.

At the end of the heating chamber 11 of furnace 1 opposite to that of the charging door 2 a heating burner 3 is provided. The heating burner 3 is located on the same side of the furnace as the exhaust. In some cases, the burner 3 is located adjacent to or in the exhaust stream port 7 to which the exhaust duct 4 connects (e.g., to permit the exit of the exhaust stream resulting from heating). In the exhaust duct 4 a thermo-couple 5 is disposed with which the temperature of the exhaust stream is measured and from which data the temperature change dT/dt is calculated. Close to the thermocouple 5 in the exhaust duct 4 of furnace 1 an IR flame scanner 10 is provided upstream from the thermocouple 5.

The charging door 2 of heating chamber 11 co-rotates with the latter in operation thereof. The heating burner 3 and the exhaust duct 4 at the opposite ends are disposed non-rotating, however.

In the heating process a flame 9 is generated by the burner 3 which extends into the heating chamber 11 of furnace 1. Typically, the flame extends at least two-thirds of the length of the furnace. Due to the heat applied by the flame 9 the charging stock 6 is heated and typically melts with continuous rotation of the heating chamber 11 of furnace 1 so that a more-or-less consistent heating of the stock 6 is achieved.

Optionally, a lance 8 may be present above burner 3 through which further oxygen/oxygen-containing gas is introduced into the heating chamber 11 of furnace 1, so that the flame 9 is boosted. The lance 8 can be located at any suitable location including the same or different side of the furnace as the burner.

The exhaust stream materializing from this heating procedure is introduced through exhaust stream port 7 into exhaust duct 4, it thereby flowing past the flame of heating burner 3 so that noxious substances contained in the waste gas such as e.g. hydrocarbons can be incinerated.

The volume of fuel and/or combustion air or oxygen required for combustion applied to the burner 3 is, and optionally also the rotation of the heating chamber 11 of furnace 1 are, adjusted as a function of the signals from the thermocouple 5 and the flame scanner 10 disposed in the exhaust duct 4. Thus, the energy offered in the heating chamber 11 of furnace 1, resulting from the combustion of the fuel and the incineration of contaminants, is maintained constant, to ensure an homogeneous sequence in the heating procedure and to minimize the noxious substances in the waste gas resulting from the heating process.

At the start of the heating process firstly the organic components present in the charging stock 6 are pyrolysed which results in a high concentration of hydrocarbons in the heating chamber 11. To compensate for that, the procedure described below based on the temperature change dT/dt of the exhaust gas stream and the signal from the IR flame scanner is initiated. With the additional oxygen and the reduced amount of the fuel fed into the heating chamber 11, the hydrocarbons present in the heating chamber 11 are incinerated so that the concentration thereof is reduced.

On completion of volatilization of the organic components of the charging stock 6 which is detectable by the decrease of the temperature change dT/dt of the exhaust stream the burner 3 is again operated stoichiometrically or weakly understoichiometrically with increased firing rate so that the fuel availability via the burner 3 increases in the furnace 1 and heating of the charging stock 6 is quickly attained, the concentration of oxygen in the furnace 1 being slight so as to avoid loss of aluminum.

The concentration by volume of the noxious substances resulting from pyrolysis during heating such as e.g. hydrocarbons depends, among other things, on the rotative speed of the heating chamber 11 of furnace 1, thus by means of the signals of the thermocouple 5 and the flame scanner 10 the rotary movement of the heating chamber 11 may be adjusted so that the volume of noxious substances is further minimized.

In this embodiment of a rotary drum furnace 1, the adjustment of the oxygen and fuel introduction into the heating chamber 11 can be done based on the signal of the optical sensor (IR flame scanner) and the temperature change dT/dt of the exhaust gas stream in the following way:

IR flame scanner 10 installed in the exhaust duct detects the variation in IR radiation and hence the flame strength as an electronic analogue signal which varies between 0 and 100%. At the same time, thermocouple 5 in the duct measures the temperature of the exhaust gas stream.

Both signals are fed into a control device where the change dT/dt of the measured temperature is electronically calculated. The control device causes the oxygen and/or fuel adjustment based on both signals by the following procedure:

i) decrease the actual fuel flow $Q_{f,act}$ to the reliable minimum $Q_{f,set,min}$, ii) increase the amount of the oxygen introduced to the furnace $Q_{O2,act}$ in accordance with the level of the signal of the IR flame scanner, iii) ramp down amount of oxygen $Q_{O2,act}$ with a predetermined rate during a predetermined time to the normal level, iv) return fuel flow $Q_{f,act}$ to normal heating conditions $Q_{f,set,norm}$ when finished.

Depending on the settings and the quality of the charged material, this procedure may start several times after charging has finished and furnace door 2 is closed.

To avoid unwanted activation of the procedure, starting conditions are set which may differ for individual furnaces. Thus, to initiate the above procedure the starting conditions are such that the signal from the IR flame scanner must be higher than a predetermined level, and, at the same time, the temperature change $dT/dt_{set,start}$ in the exhaust stream must be higher than a predetermined value.

Furthermore, a second temperature change point dT/dtset, stop is preset for the deactivation of the adjustment procedure, which allows to incorporate some hysteresis in the system and prevents false signal detection.

To allow different settings at different temperature levels, a second set of parameters may be added. This is necessary to cover the situation where a different temperature change to activate/deactivate the system should be applied when operating in a higher or lower temperature slot.

The need of additional oxygen is calculated according to the signal from the IR scanner ($IR_{act}$). The relationship between $IR_{act}$ and increase of the oxygen flow $Q_{O2}$ is preset.

The required total oxygen flow QO2act to be introduced into heating chamber 11 is then calculated in the control device The system then decreases QO2add via a ramp calculation If during ramping down another signal peak from the IR flame scanner occurs which has a corresponding oxygen level that is higher than the actual position of the ramp, a new oxygen flow rate is calculated and ramp starts again with the new value.

The system may also for safety reasons deactivate or prevent activation when, for example due to repeated ramp restart, a maximum time after closing the charging door 2 is reached. A maximum activation time may also be set to avoid wrong parameters leading to a continuous oxygen rich operation.

Although the adjustment procedure has been described for the example of a rotary drum furnace, it may equally well be applied to other embodiments of heating furnaces.

Figure 2:
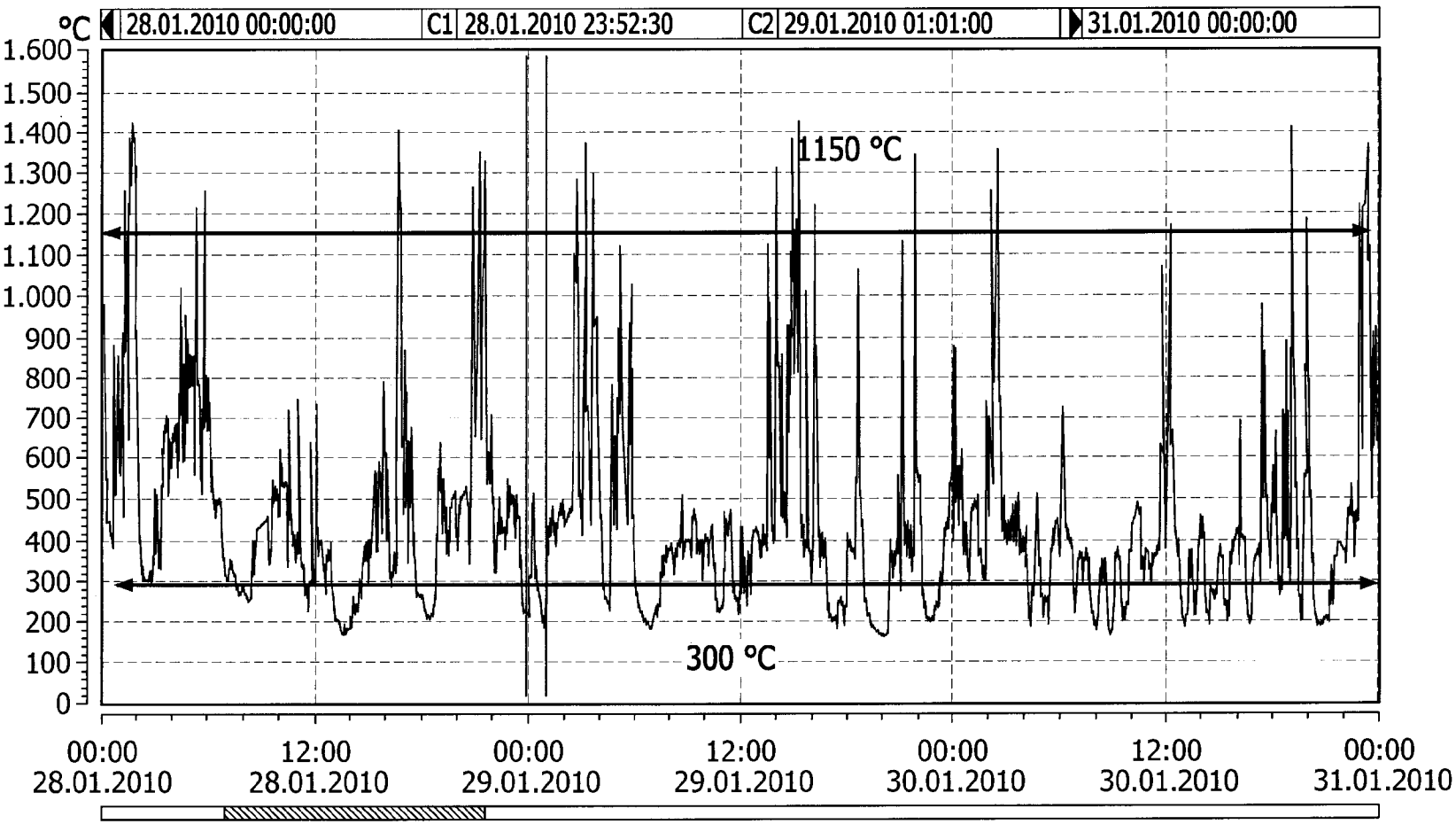
FIG. 2 shows the temperature development of the exhaust gas stream of a heating furnace in which aluminum scrap heating is performed without adjustment of the oxygen: fuel ratio in accordance with the present invention.
Figure 3:
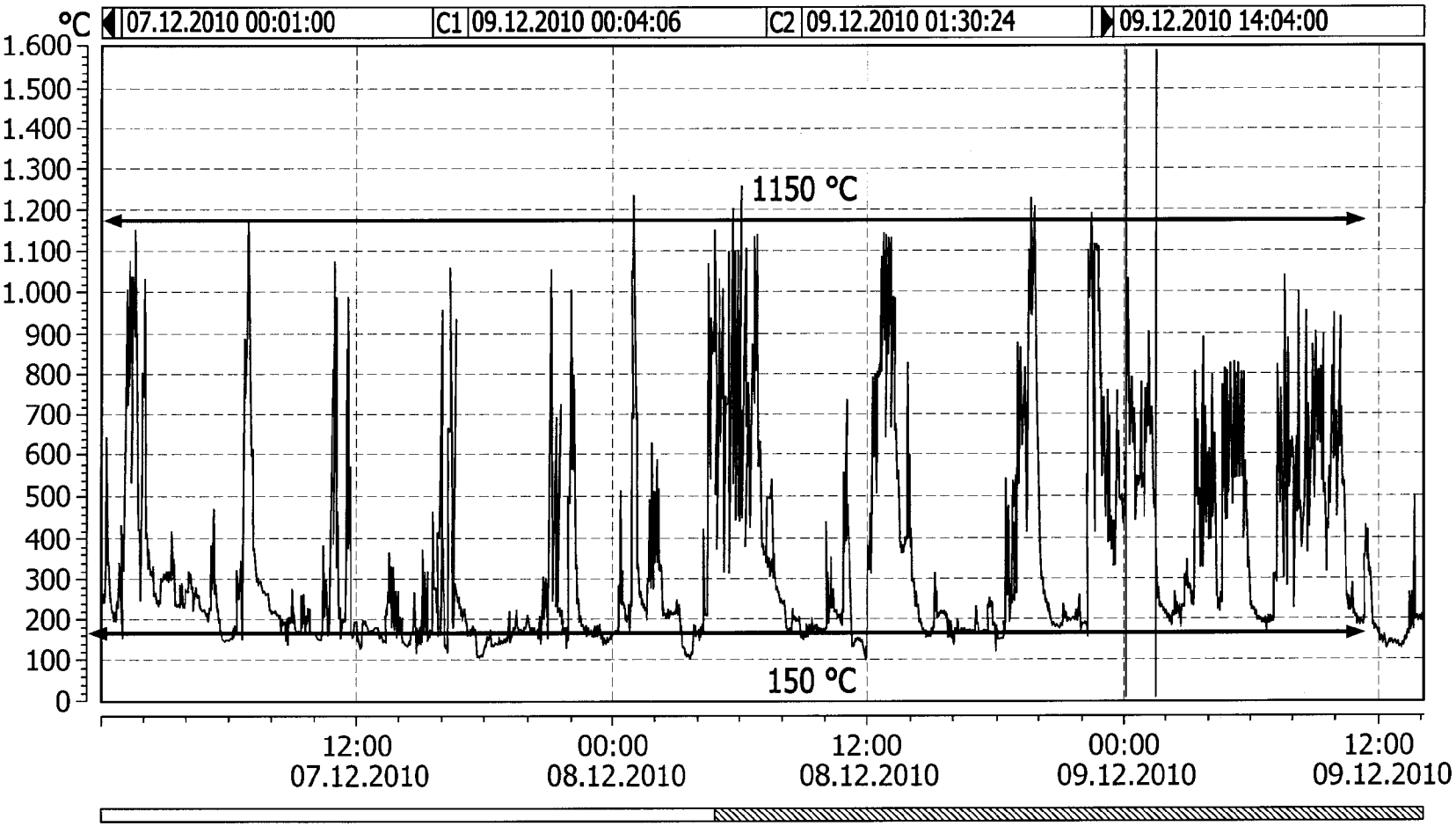
FIG. 3 shows the temperature development of the exhaust gas stream of a heating furnace in which aluminum scrap heating is performed with adjustment of the oxygen: fuel ratio in accordance with the present invention.

As can be seen from a comparison between FIGS. 2 and 3 the exhaust stream temperature of a heating furnace is more homogeneous, in particular temperature peaks (far) above 1150° C. can be avoided. This indicates that combustion in the exhaust duct 4 caused by excess combustibles in the heating chamber 11 can be avoided as far as possible.

The invention claimed is:

1. A method of heating a non-ferrous and/or ferrous metal-containing stock containing organic components in a furnace with a heating chamber, a charging door, an exhaust stream port and an exhaust stream duct, the method comprising:

a) introducing into the furnace stock containing organic components, b) introducing fuel and an oxygen-containing gas into the heating chamber of the furnace through a burner so that a flame is formed, c) heating the stock and thereby pyrolyzing the organic components, d) monitoring the combustion intensity of the exhaust stream during said pyrolysis using at least one optical sensor installed within the heating chamber and/or the exhaust stream, e) monitoring the change of the temperature T of the exhaust stream with time (dT/dt) during said pyrolysis, and f) adjusting the fuel:oxygen ratio in step b) in response to the combustion intensity and dT/dt in the exhaust stream during said pyrolysis.

2. The method according to claim 1 wherein the furnace is a rotary drum furnace.

3. The method according to claim 1 wherein the non-ferrous and/or ferrous metal is aluminum.

4. The method according to claim 1 wherein the fuel: oxygen ratio is adjusted by varying the amount of oxygen introduced into the furnace and/or varying the amount of fuel introduced into the furnace.

5. The method according to claim 1 wherein the at least one optical sensor is installed within the exhaust stream duct of the furnace.

6. The method according to claim 1 wherein dT/dt of the exhaust stream of the furnace is recorded downstream of the location of the optical sensor(s).

7. The method according to claim 1 wherein the at least one optical sensor is an IR sensor.

8. The method according to claim 1 wherein dT/dt of the exhaust stream is measured with a thermocouple.

9. The method according to claim 1 wherein the charging door and the exhaust stream port are located at opposite sides of the furnace.

10. The method according to claim 1 wherein the fuel and the oxygen-containing gas are introduced into the furnace from the same side where the exhaust stream port is located.

11. The method according to claim 1 wherein additional oxygen-containing gas is introduced into the furnace through a lance.

12. The method according to claim 11 wherein the lance is positioned so that the additional oxygen-containing gas introduced into the furnace boosts the burner flame.

13. The method according to claim 12 wherein the lance is positioned above the burner.

14. The method according to claim 1 wherein a charging stock is introduced into the furnace through the charging door in a continuous manner.

15. The method according to claim 1 wherein the oxygen-containing gas has an oxygen content of at least 80%.

16. An apparatus for performing the method of claim 1 which comprises a furnace with a heating chamber, a charging door, an exhaust stream port, and an exhaust stream duct, and a) a burner for introducing fuel and an oxygen-containing gas into the heating chamber so that a flame is formed, b) at least one optical sensor installed within the heating chamber and/or exhaust stream duct, c) means for monitoring the change of the temperature T of the exhaust stream with time (dT/dt), and d) means for adjusting the fuel: oxygen ratio in step a) as a function of the signal of the flame sensor(s) and dT/dt in the exhaust stream.

* * * * *